US005131449A

United States Patent [19]

Winn et al.

[11] Patent Number: 5,131,449

[45] Date of Patent: Jul. 21, 1992

[54] FOLDING DOOR STORAGE SYSTEM FOR A CLOSET

[75] Inventors: Klaus K. Winn, Giessen; Karl L. Engelbach, Dillenburg; Ulrich Franz, Haiger, all of Fed. Rep. of Germany

[73] Assignee: Weyel KG, Haiger, Fed. Rep. of Germany

[21] Appl. No.: 629,237

[22] Filed: Dec. 18, 1990

[30] Foreign Application Priority Data

Dec. 22, 1989 [DE] Fed. Rep. of Germany ..... 3942584

[51] Int. Cl.[5] ..... E05D 15/26

[52] U.S. Cl. ..... 160/199; 160/214; 160/206; 312/322

[58] Field of Search ..... 160/199, 210, 203, 206, 160/214; 49/257; 312/110, 322

[56] References Cited

U.S. PATENT DOCUMENTS 3,994,330 11/1976 Laby ..... 160/199
4,945,972 8/1990 Takeuchi ..... 312/322

FOREIGN PATENT DOCUMENTS 804087 10/1936 France ..... 312/322
329353 9/1935 Italy ..... 312/322
23325 of 1898 United Kingdom ..... 312/322

*Primary Examiner*—Blair M. Johnson
*Attorney, Agent, or Firm*—Flynn, Thiel, Boutell & Tanis

[57] ABSTRACT

A folding door storage system for an opening of a closet including a first door panel and a second door panel, which panels are pivotal with respect to one another, and a carrier arrangement which can be moved, in a folded state of the door panels in which they are aligned parallel with one another, together with the door panels into a storage space. In order to achieve a safe guiding and moving of the door panels and in order to be able to use the system also for very large dimensions, the first door panel is mounted for movement transversely with respect to the front side of the closet on a guide rail by means of a guide element, wherein the guide element, in the folded state of the door panels, can be transferred into a second guide rail arranged parallel with respect to an outside wall of the closet. A locking mechanism is mounted on the carrier arrangement, which locking mechanism prevents unintended movements and swivellings of the door panels.

14 Claims, 11 Drawing Sheets

FOLDING DOOR STORAGE SYSTEM FOR A CLOSET

FIELD OF THE INVENTION

The invention relates to a folding door storage system for a closet, in which a first door panel is supported on a second door panel by means of a first hinge arrangement, and in which the second door panel is mounted on a carrier arrangement by means of a second hinge arrangement, which carrier arrangement is horizontally movably supported on an outside wall of the closet.

BACKGROUND OF THE INVENTION

Closets always seem to have the problem that their doors, when open, project into the room in which the closet is located. This is of no importance for a normal closet since the doors are always only open for a short period of time in order to place articles into the closet or in order to remove articles from the closet. However, for closets which are supposed to remain open for a longer time period, outwardly projecting, open doors are not desired since they, on the one hand, hinder the access to or the view into the inside of the closet and, on the other hand, require a considerable amount of space.

To avoid these disadvantages, systems have been developed, for example for filing cabinets, in which systems the doors have been replaced by rollable covers, as this is known from roll cabinets, in which the cover can be moved either upwardly or to the side. This design has the disadvantage that a complicated guiding and moving mechanism is needed in order to enable a smooth movement of the cover. Furthermore, such constructions are limited in size since one person, in particular in the case of very high and/or wide cabinets, often does not have the necessary strength to operate such cover.

Folding door storage systems are furthermore known from the state of the art, in which the door of a closet is divided into two door panels, which are hingedly connected with one another. Upon opening the door panel hinged to the outside of the closet, it is thus possible to arrange the other door panel parallel to the first door panel. Thus, the two door panels project a small distance in the open condition into the respective room. In order to now remove completely the door panels in the open condition of the closet from the front area of the closet, storage devices have been developed to facilitate the open door panels, arranged parallel to one another, to be moved inside of the closet. In order to enable this storing movement, the outer door panel is hinged to a carrier arrangement, which in turn is movable parallel with respect to the inside of the closet outside wall through a suitable guide mechanism. Rails with ball-roller guides are, for example, provided for this purpose. The disadvantage of this design is that there always exists the danger that both door panels swivel relative to one another during the storing movement and thus become jammed inside of the closet or rather prevent a further movement into the closet or out of the closet. A further disadvantage of this design is that the entire weight of the door panels must be supported on the carrier arrangement so that same must have considerable dimensions in the case of larger door panels or larger closets. In spite of this, this known construction is suited only for smaller closets because a secure swivelling and moving of the door panels of larger closets is not possible.

SUMMARY OF THE INVENTION

The basic purpose of the invention is to provide a folding door storage system of the above-mentioned type, which with a simple design and easy handling capability, avoids breakdowns in operation and is suited also for very large closet openings.

The purpose is attained according to the invention by the first door panel being guided by means of a guide element on at least one edge area on a first guide rail arranged parallel with respect to the front open side of the closet, by the guide element being able to be guided, when the door panels are folded, in a second guide rail arranged parallel with respect to the outside wall of the closet, and by a locking mechanism being arranged on the carrier arrangement, which locking mechanism prevents a movement of the carrier arrangement when the door panels are not completely folded as well as a swivelling of the door panels when in the stored condition.

The system of the invention is distinguished by a number of significant advantages. Since two guide rails are provided according to the invention, it is assured that the door panels, both during the normal swivelling operation and also during the storing operation, are additionally guided and held in a safe manner. Thus, the possibility is created to handle also very large closet openings, for example closet openings having a width of up to 3 m and door heights of 2.5 m and more.

A further important advantage of the system of the invention is that a locking mechanism is mounted on the carrier arrangement, which locking mechanism in a very simple manner controls the respective function of the system and prevents faulty functioning. Thus, the locking mechanism prevents the storing operation from starting before the two door panels are completely folded, that is, are aligned exactly parallel to one another. The locking mechanism prevents further the door panels during the storing operation from swivelling relatively to one another and thus jamming up in the closet. Thus, additional measures and operating steps are not needed. The system of the invention offers thus the highest degree of operating safety and comfort using a very small number of individual parts and, therefore, untrained personnel can operate the system without first receiving instructions. Thus, damage to the closet or rather to the folding door storage system can be totally avoided.

A further important advantage of the system of the invention is that the door panels are guided in an exact, predetermined path of movement, since both the first and also the second guide rail assure a forced guiding of the first door panel, namely, of the outside edge of the respective door arrangement. In this manner it is achieved that the two door panels can be moved into the closet only after they are folded and aligned parallel to one another so that then the guiding function is automatically transferred over to the second guide rail. During an oppositely directed movement, namely, when the two door panels are pulled out of the closet, the guiding function is transferred to the first guide rail only after the pulling-out operation has been completely concluded to thereby facilitate the two door panels to be swivelled without causing a damage to the system.

An advantageous further development of the invention provides that the locking mechanism includes a lever pivotal about a horizontal axis, which lever is engaged by the first door panel so as to be swivelled thereby into a release position and which, in its so called at rest position, engages a stop to prevent a storing of the door panels in the closet. Thus, the lever of the invention causes automatically a blocking of the storing movement before the two door panels are aligned exactly with one another. An automatic unblocking, namely, a release of the lever, occurs at the same time by the approach of the first door panel to the second door panel and the fully folded relation thereof. Since the lever is supported on the carrier arrangement, it is prevented at the same time that the lever can be operated before the second door panel is aligned parallel with the outside wall of the closet. The blocking function during the storing operation, which blocking function is to be caused by the lever, is thus achieved automatically during the folding of the two door panels during an opening of the closet.

Furthermore, it is advantageous when the lever is initially biassed into a blocking position by means of a spring element. The initial tension assures on the one hand that the lever is not erroneously moved into its release position by other influences, for example vibrations, before the two door panels are completely folded. Furthermore, the initial spring force can be used to spread the two door panels apart after they have been pulled out of the closet to cause in this manner a swivelling of the first door panel with respect to the second door panel and a transfer a guiding of the guide element into the first guide rail.

The guide element is preferably supported on the free end of the first door panel since in this manner the most favorable force relationships and the best guiding of the first door panel are assured.

It is furthermore particularly advantageous according to the invention when the first and the second guide rail are arranged above the door panels, namely, the guide element hangs in the two guide rails. This embodiment is, on the one hand, advantageous for reasons of appearance, since the guide rails cannot or can hardly be seen and since, on the other hand, it is avoided that articles fall into the guide rails and adversely influence the operation of the system.

A particularly advantageous development of the invention provides that the guide element has a platelike attachment arranged perpendicularly with respect to the door-panel plane when the doors are in the completely folded state, which attachment can be guided into a slot in the lever. Thus, during the unblocking state of the lever, the platelike attachment is in the lever in such a manner that a relative movement between the lever and the attachment is possible only in direction of the centerplane of the attachment or of the groove in the lever, not, however, in a laterally swivelled relative position, which would occur for example when the first and the second door panels would be swivelled relative to one another. Thus, the platelike attachment is used to hold the two door panels in their folded parallel aligned position when they are moved into the closet as well as when they are in the stored position or are pulled out of the closet. It is thereby advantageous when the slot in the lever is constructed at the free end area of the lever because a particularly favorable torque transfer becomes possible and because the size of the platelike attachment can be chosen independently from the remaining design of the lever.

The carrier arrangement provided according to the invention includes preferably a carrier element, which has a L-shaped cross section, with a first leg of the carrier element being aligned parallel with the outside wall of the closet, while a second leg is arranged extending toward the inside open area of the closet. The carrier element is thus designed like an angle element which, on the one hand, enables a safe fastening to the moving mechanism along the outside wall of the closet and, on the other hand, creates sufficient space for storing the lever. The lever can thus be guided and held in a safe manner, with additional, large-dimensioned supports, for example in the form of a bearing axle or the like not being needed.

In order to improve the guiding and mounting of the lever and in order to increase its lateral stability, it is provided that the second leg has a rounded arch-shaped portion on its upper edge and is received in an arch-shaped groove in the lever.

The lever is furthermore advantageously supported at its center area on the second leg of the carrier element, while the lower end of the lever, in the blocking position to block movement of the carrier element, can be guided into a recess in the outside wall of the closet. In dependency of the design of the closet, it is thus not necessary that the lever, which extends or is initially inclined in direction of the inside of the closet, supports the inside wall of the closet, which inside wall covers the doors and the moving mechanism. Rather, it is sufficient to provide a recess only on the outside wall of the closet.

Furthermore the hinge arrangement for the second door panel is supported preferably on the carrier element because further and additional support elements are then not needed.

The spring element for providing the initial biassing force of the lever is advantageously hinged to the lower end of the lever and is fastened with its second end to the carrier element. From this result favorable forced starting relationships for the lever.

The guide element has the purpose according to the invention of supporting and holding the free end of the first door panel both during the swivelling operation and also during the storing operation. For this purpose it is provided that the guide element has four guide wheels for engagement with the first guide rail, which wheels are each rotatable about a horizontal axis. It is thereby naturally necessary that the guide element is itself pivotally supported on the first door panel. The guide element has furthermore an upper guide wheel which is used to support the guide element during a storing movement in the second guide rail. Since during the storing movement only a movement along the second guide rail occurs, a canting or tilting is not to be feared so that one single guide wheel is sufficient, while the four guide wheels guarantee during a movement along the first guide rail an exact rectilinear movement without the danger of a canting or tilting.

In order to facilitate the carrier element being moved evenly along the guide mechanism on the outside wall of the closet, it is provided that a gear is rotatably supported on the upper and lower area of the carrier element, each gear of which mates with a horizontal rack arranged on the inside of the outside wall. The two gears are preferably fastened on a common axis so that it is assured that the upper and the lower area of the carrier element are each moved along the same path.

In order to remove any play from the gear-rack arrangement and in order to guarantee an even movement of the carrier element, it is provided that the rack and the gear are each constructed in duplicate, with the duplicated areas of both the rack and also of the gear being each offset with respect to one another a portion of the pitch.

BRIEF DESCRIPTION OF THE DRAWINGS

The invention will be described hereinafter using one exemplary embodiment and in connection with the accompanying drawings, in which.

DETAILED DESCRIPTION

Figure 1:
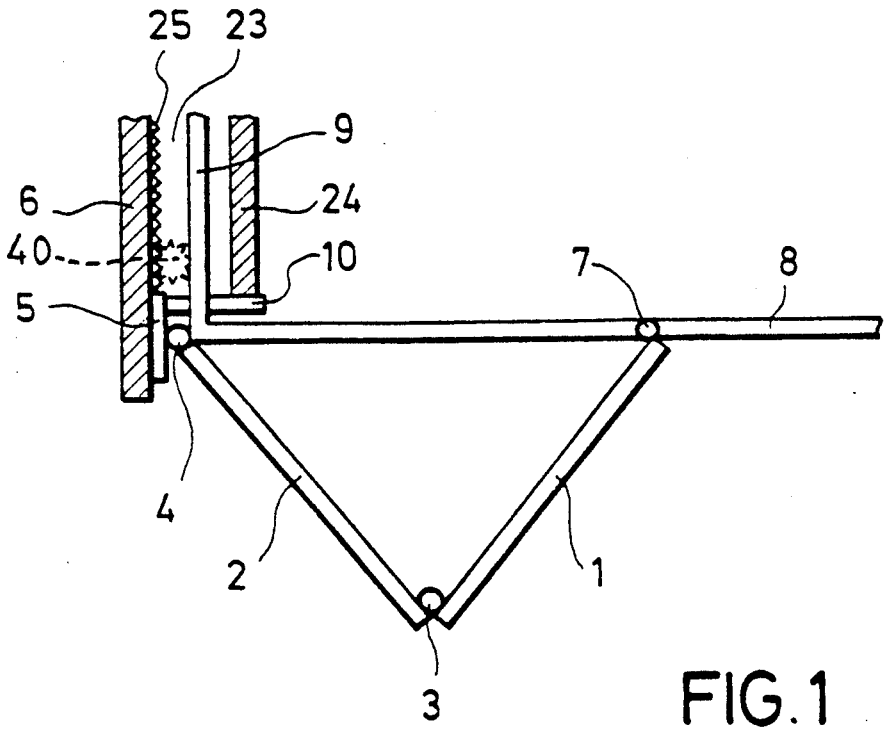
FIG. 1 is a schematic top view of a system embodying the invention in a partially swivelled state of the door panels.

FIGS. 1-4 show schematically illustrations of the general design and indicate the general operational sequences of the folding door storage system embodying the invention. The closet door system includes symmetrically designed left and right sides. To simplify the illustration, only the operation of the left side will be hereinafter described. The left side includes a first door panel 1 and a second door panel 2, which panels are connected to one another through a first hinge arrangement 3. The second door panel 2 is supported on an outside wall 6 of the closet through a second hinge arrangement 4, which is shown only in a simple and schematic form in FIGS. 3 and 4. When the closet is closed, both door panels 1 and 2 are aligned with one another and close the opening of the closet, while for opening of the closet, the two door panels 1 and 2 can be swivelled relative to one another, as this is shown in the schematic illustration of FIG. 1. After both door panels 1 and 2 have been swivelled to the folded opened position, they are aligned parallel to one another and can be moved into a storage space 23 of the closet, which space is formed by the outside wall 6 and an inside wall 24.

The second hinge arrangement 4 is mounted on a carrier arrangement 5, which carrier is movable parallel to the outside wall 6 in a horizontal direction by guide rails (not illustrated) and with the help of ball-bearing rollers or the like, in order to facilitate a movement of the door panels 1 and 2 into the storage space 23. An upper and a lower rack 25 are also fastened on the inside of the outer wall 6. A gear 40 mates with each of the racks, only one gear is shown in FIG. 1, which gear is rotatably supported on the carrier arrangement 5. This assures that an uneven path of movement as well as a canting of the carrier arrangement 5 is avoided.

Figure 2:
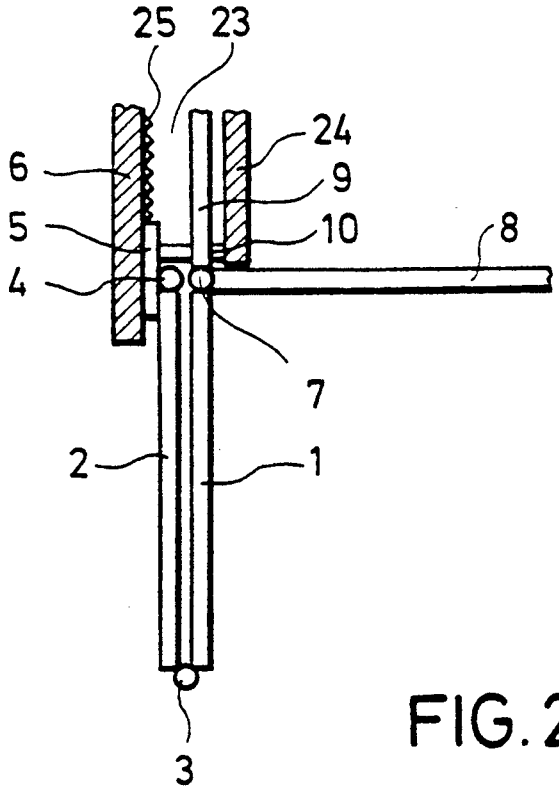
FIG. 2 is an illustration, corresponding to FIG. 1, of the completely swung back, not yet stored condition of the door panels.
Figure 3:
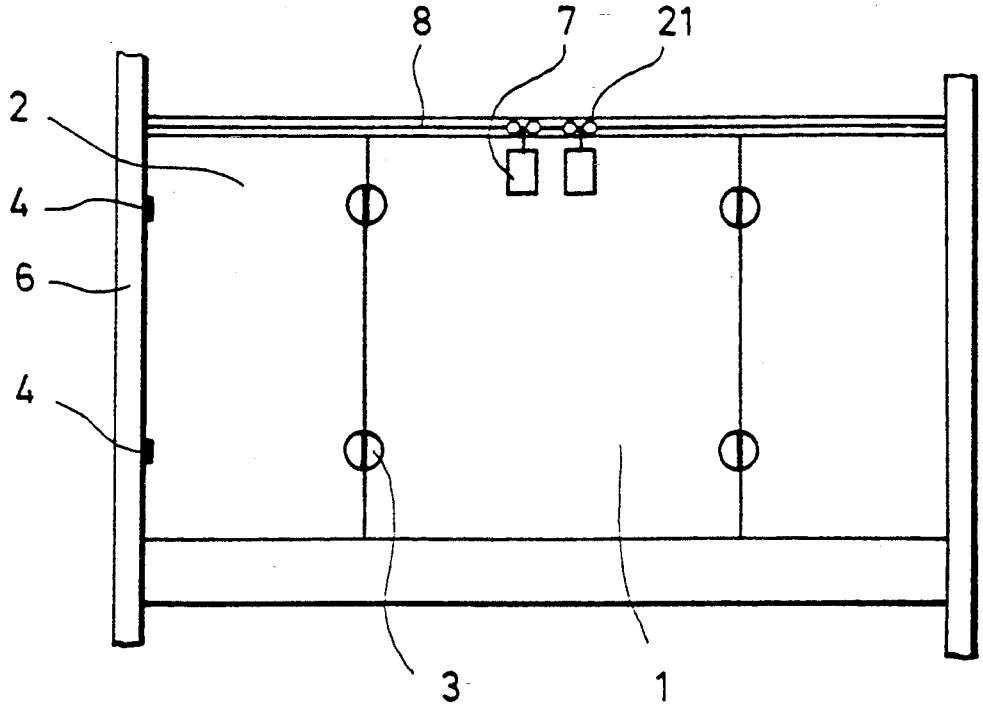
FIG. 3 is a schematic front view of a portion of a closet equipped with the system of the invention.
Figure 4:
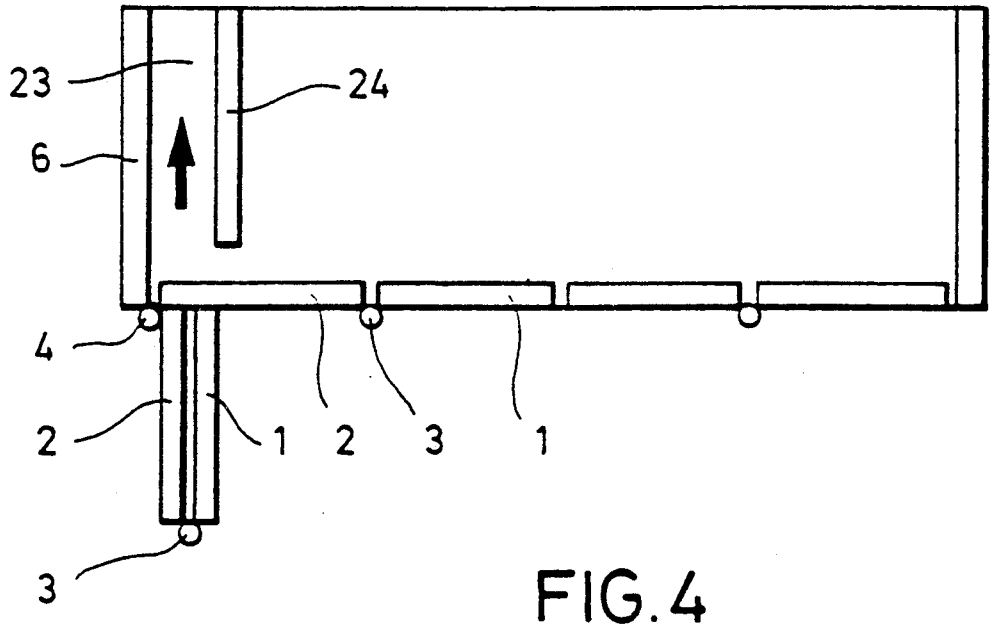
FIG. 4 is a schematic top view of the arrangement shown in FIG. 3, with the door panels having been swivelled to the open position and the storing direction being indicated by the arrow.

A guide element 7 is mounted on the free end of the first door panel 1 and is movable in a first, horizontal guide rail 8, mounted transversely with respect to the closet opening, and during the swivelling operation of the door panels 1, 2. The guide rail 8 provides vertical support for the door panels and suitably holds the first door panel. The guide rail 8 passes over into a second guide rail 9 arranged parallel with respect to the outside wall 6 and which is schematically illustrated in FIGS. 1 and 2. After both door panels 1, 2 have been completely swivelled into their open parallel position, the guide element 7 is transferred from the guide rail 8 over to the second guide rail 9 so that the two door panels 1, 2 are securely held and guided also during the storage operation. Also, the second guide rail 9 has the purpose of providing vertical support.

A locking mechanism 10 is furthermore provided on the carrier arrangement 5, which locking mechanism prevents the carrier arrangement 5 from being moved into the storage space 23 before the two door panels 1, 2 are arranged in their storage position, namely, are aligned parallel to one another as shown in FIG. 2. The locking mechanism 10 furthermore causes the two door panels 1, 2 to be held in the parallel position as long as a storing movement or a pulling-out movement along the outside wall 6 is to take place.

Figure 5:
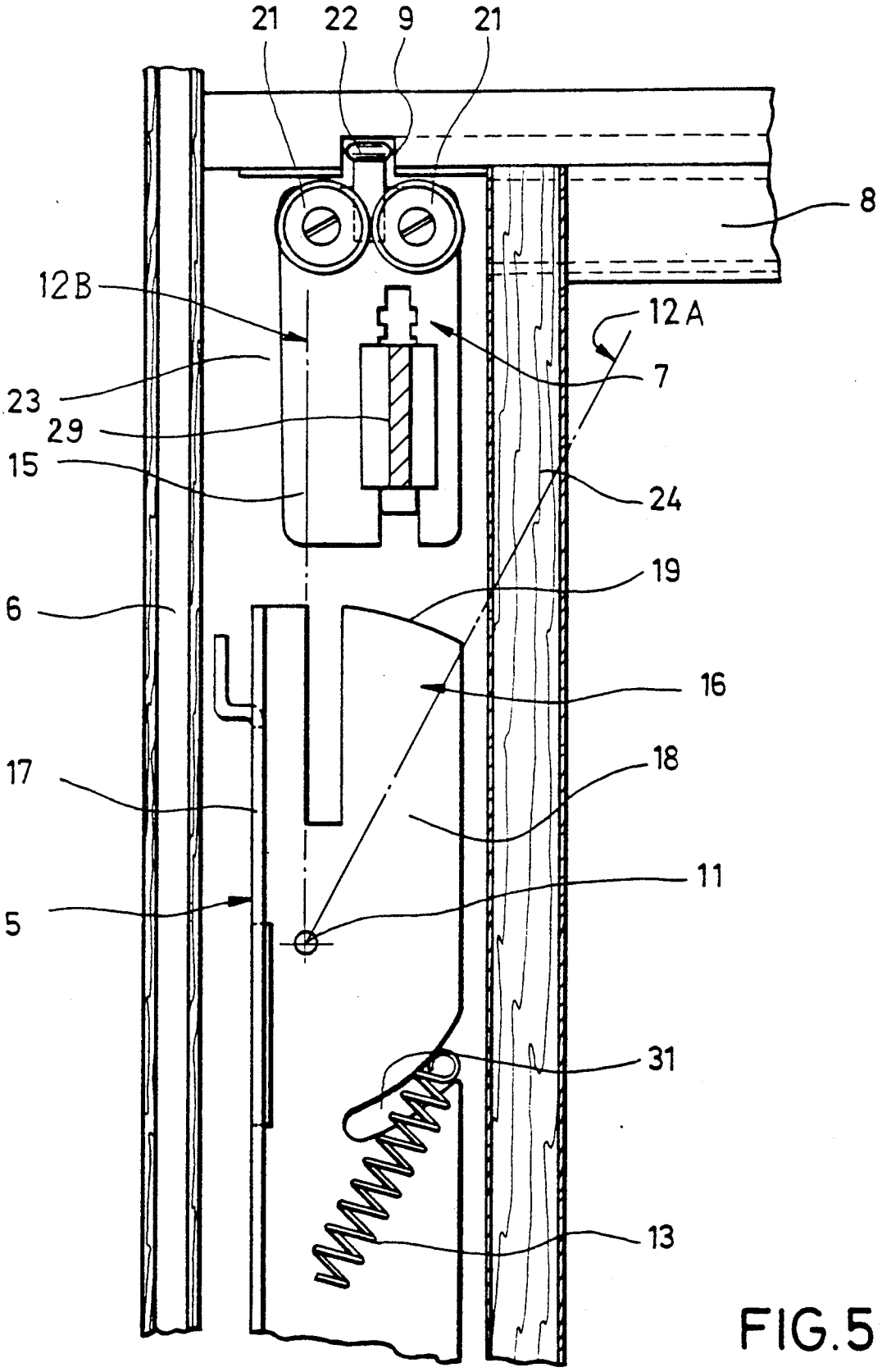
FIG. 5 is a schematic front view looking onto the storage space, partially in cross section, of the carrier element and of the guide element in the operating condition shown in FIG. 2, with the two door panels not being shown.
Figure 18:
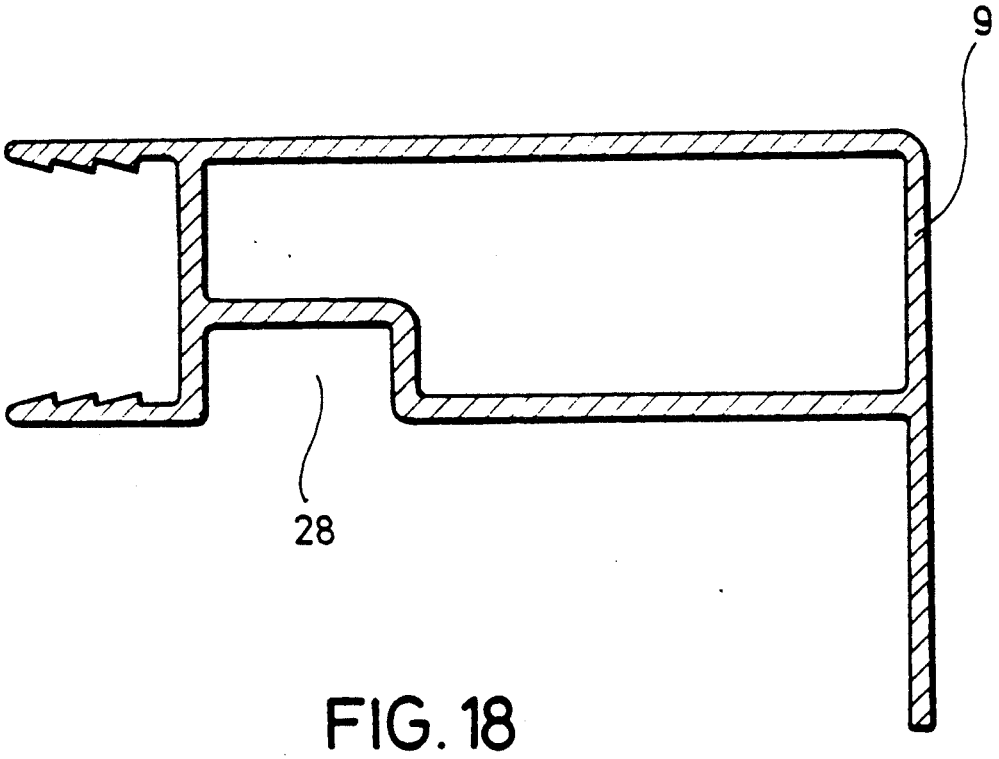
FIG. 18 is a cross-sectional view of an exemplary embodiment of the second guide rail.
Figure 17:
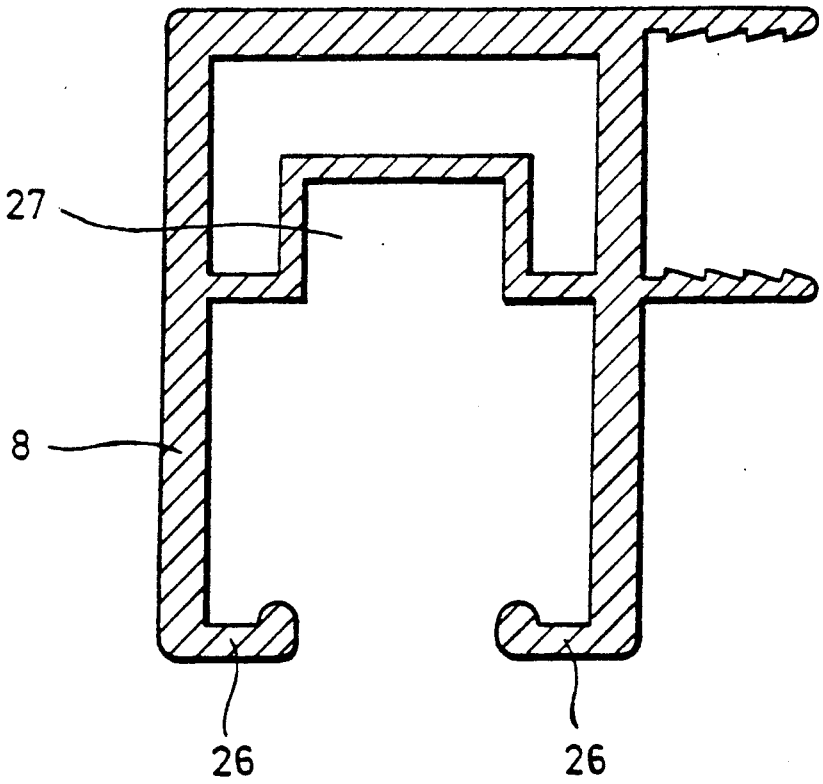
FIG. 17 is a cross-sectional view of an exemplary embodiment of the first guide rail.

FIG. 5 shows a front view of a detail of the closet embodying the invention, looking into the storage space 23. The two door panels 1, 2 are in the illustrated folded operating condition already aligned parallel to one another, similar to the illustration shown in FIG. 2, however, have been left out to facilitate a clearer understanding of the invention. The illustration of FIG. 5 shows that the guide element 7 has a platelike design, on the upper area of which are supported four guide wheels 21 arranged in pairs on both sides of the carrier and can each rotate about a horizontal axis. An upper guide wheel 22 is also arranged at the upper area of the guide element 7, which guide wheel 22 guides or rather holds the guide element 7 in the second guide rail 9. The two Figures 17 and 18 show each cross sections of embodiments of the guide rails 8, 9 or rather of the elements which form the guide rails, which elements can be mounted on corresponding wall elements of the closet. The first guide rail 8 is, as can be seen in FIG. 17, designed substantially U-shaped and includes two inwardly directed legs 26 forming the running surfaces for the guide wheels 21, as this can be seen in FIG. 19. The first guide rail 8 has in the upper area a recess 27, in which the upper guide wheel 22 can be moved without a carrying function during the movement along the first guide rail 8. FIG. 18 shows a profile of the second guide rail 9, in which in particular a recess 28 can be recognized and which is dimensioned such that the upper guide wheel 22 can run in the recess 28.

Figures 19, 20:
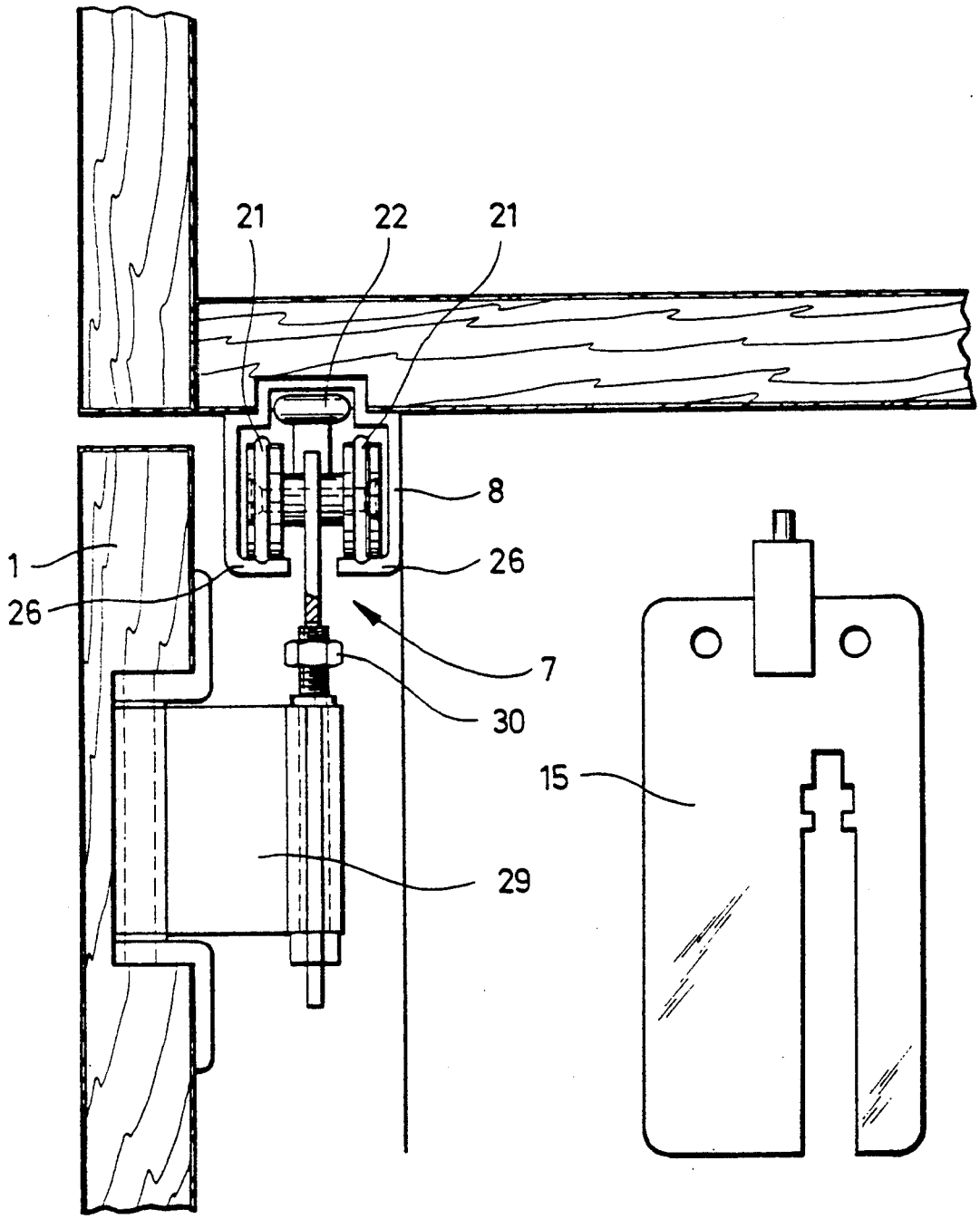
FIG. 19 is a side view, partially in cross section, of the first guide rail and of the first door panel and of the guide element.
FIG. 20 is a detail view of the carrier of the guide element.

FIGS. 19 and 20 show the guide element 7 in detail, in particular the platelike design of the carrier can be seen in FIG. 20. The carrier, which has an attachment part 15, is pivotally mounted through a rotary type fitting 29 to the first door panel 1. The guide element 7 can be elevationally adjusted by a screw 30 and a suitable threaded rod so that the guide element is exactly adjusted to the first guide rail 8 to support the door panels at the desired height relative to the guide rail 8.

Figure 7:
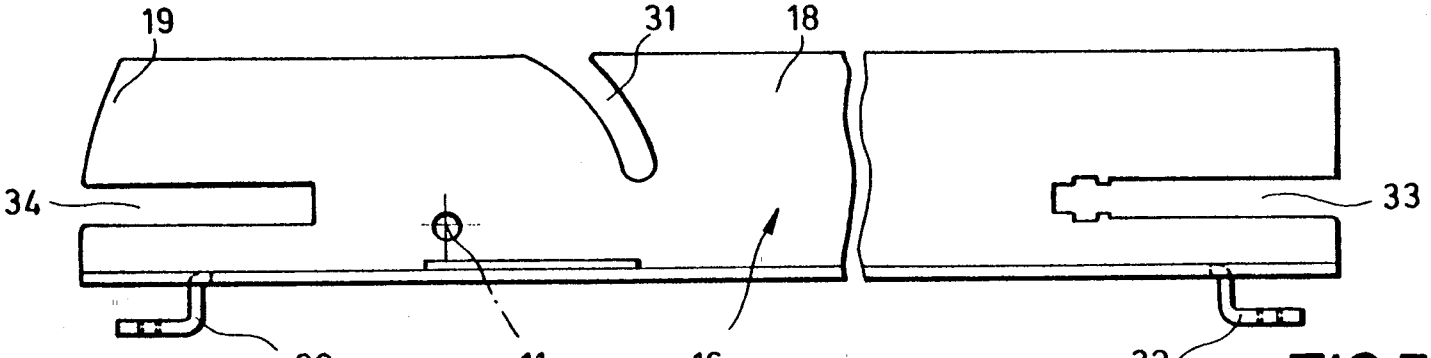
FIG. 7 is a side view of the carrier element of the invention.
Figure 8:
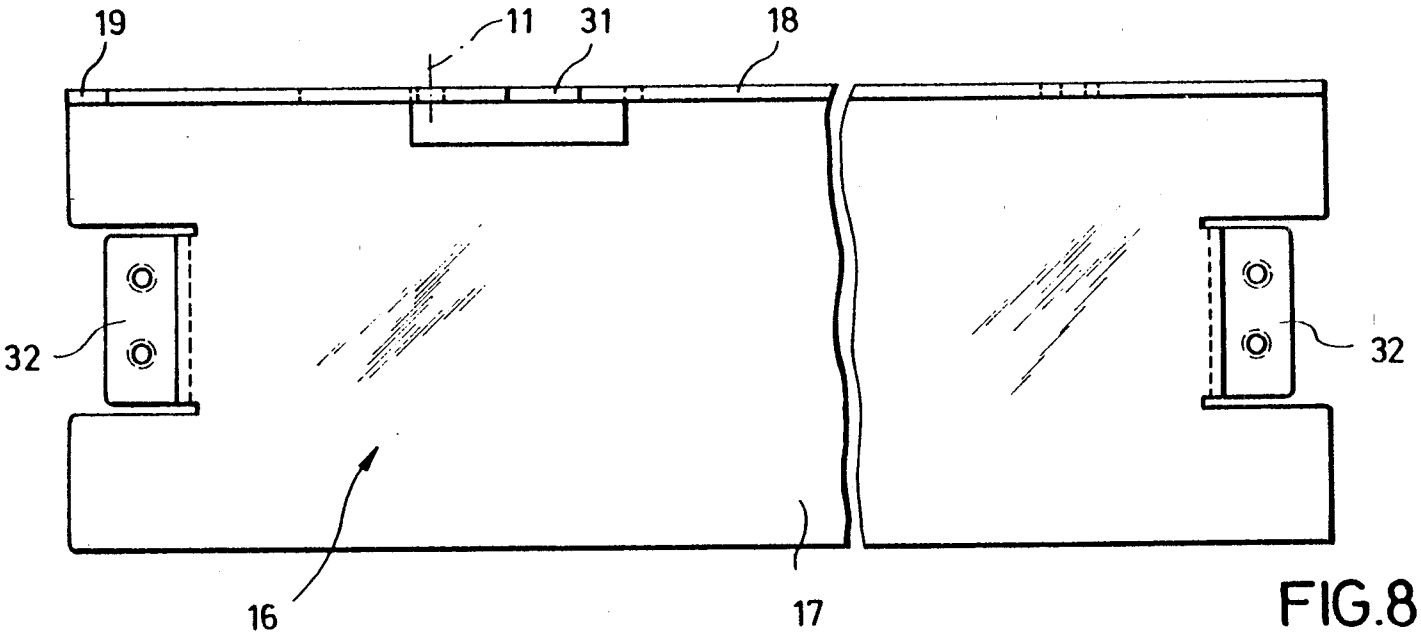
FIG. 8 is a top view of the carrier element shown in FIG. 7.
Figure 9:
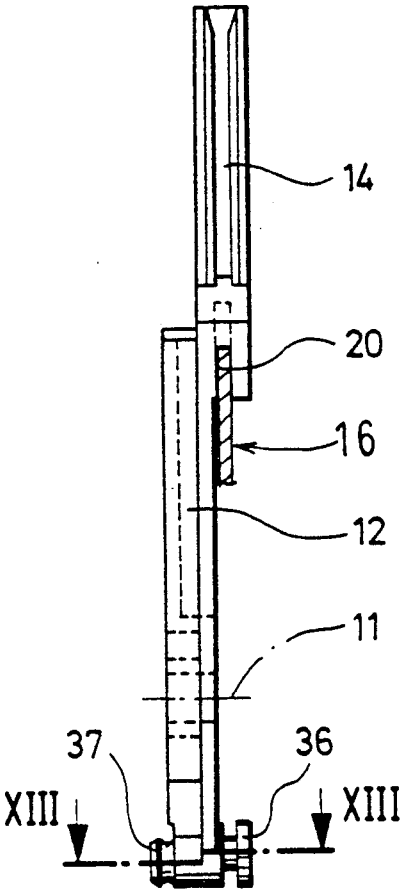
FIG. 9 is a front view of the lever of the invention.

FIG. 5 shows furthermore a carrier element 16 of the invention, which is shown in the side and in the top view in FIGS. 7 and 8. The carrier element 16 is designed in the form of an angle element and has a first leg 17 and a second leg 18, with the first leg 17 being aligned parallel with respect to the outside wall 6 of the closet, while the second leg 18 projects perpendicularly with respect to the outside wall 6 into the inside of the closet or rather the storage space 23.

The carrier element 16 has an opening therein having a horizontal axis 11, about which is pivotally supported a lever 12 (see FIG. 5A) which will be described in detail in FIGS. 11-14. The upper end of the carrier element 16 has an upper, rounded, arch-shaped edge 19, the radius of curvature of which has its centerpoint at the horizontal axis 11. A guide slot 31 is furthermore constructed in the center area, which guide slot also serves to support the lever 12 by reason of a guide pin of the lever 12 being movable in the guide slot 31. The guide slot 31 is designed arch-shaped and the centerpoint of curvature is here also located at the horizontal axis 11.

Figure 5A:
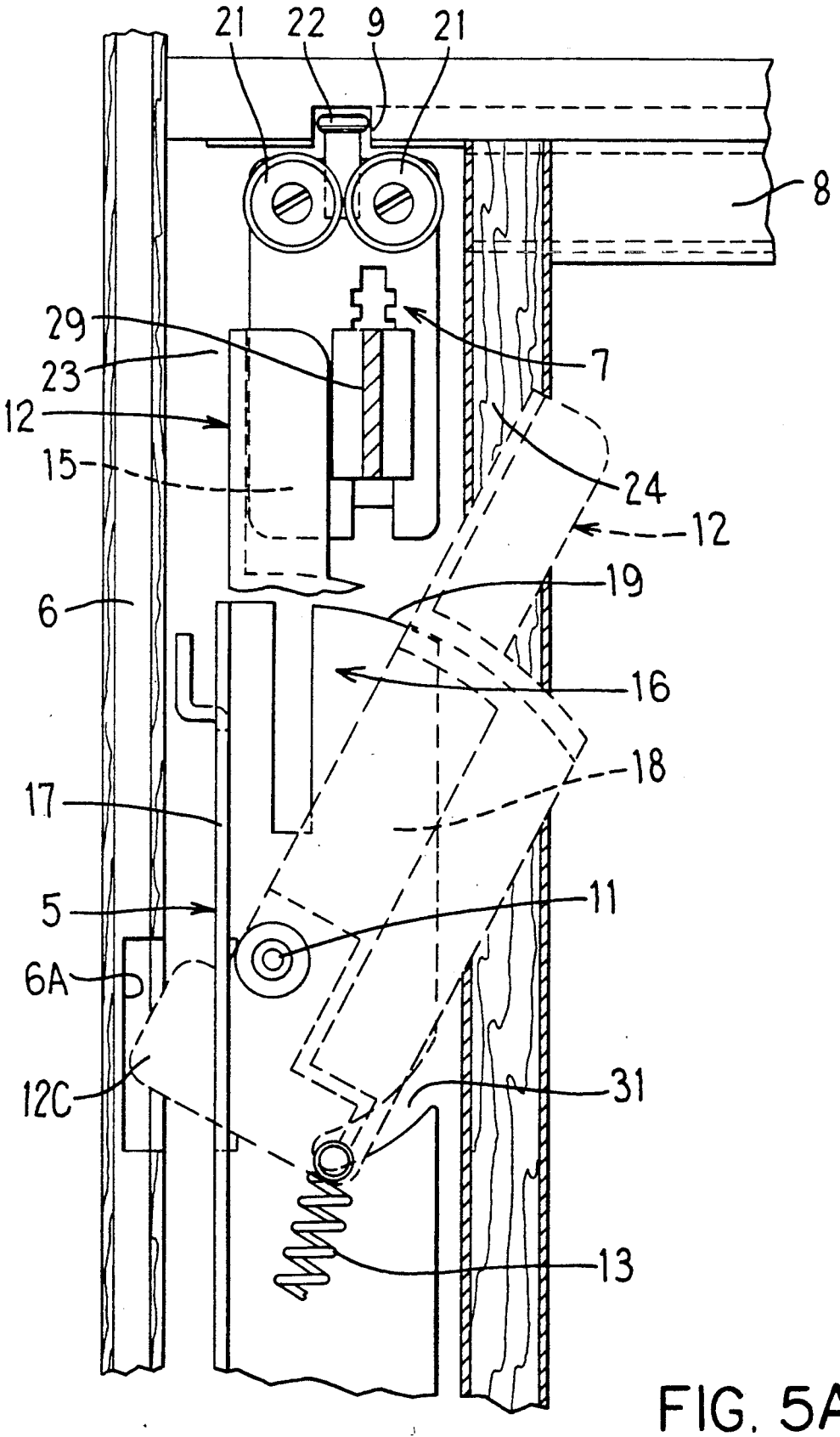
FIG. 5A is similar to FIG. 5 and shows the lever pivotally mounted on the carrier element.

FIGS. 5 and 5A also schematically illustrate a spring element 13 which is used to swivel the lever 12 into a blocking position, in which blocking position the lever prevents the door panels 1, 2 from being moved into the storage space 23.

FIGS. 5 and 5A do not show the rack 25 and the storing and guiding mechanism, with the aid of which the carrier element 16 can be moved to the outside wall 6. This mechanism is part of the state of the art. FIGS. 7 and 8 each show support feet 32 which can be fastened on roller guide cages or the like in order to facilitate a movement of the carrier element 16 relative to the outside wall 6. The slots 33, 34 constructed on the second leg 18 of the carrier element 16 are used to receive the second hinge arrangement 4 for supporting the second door panel 2 on the carrier element 16.

Figure 6:
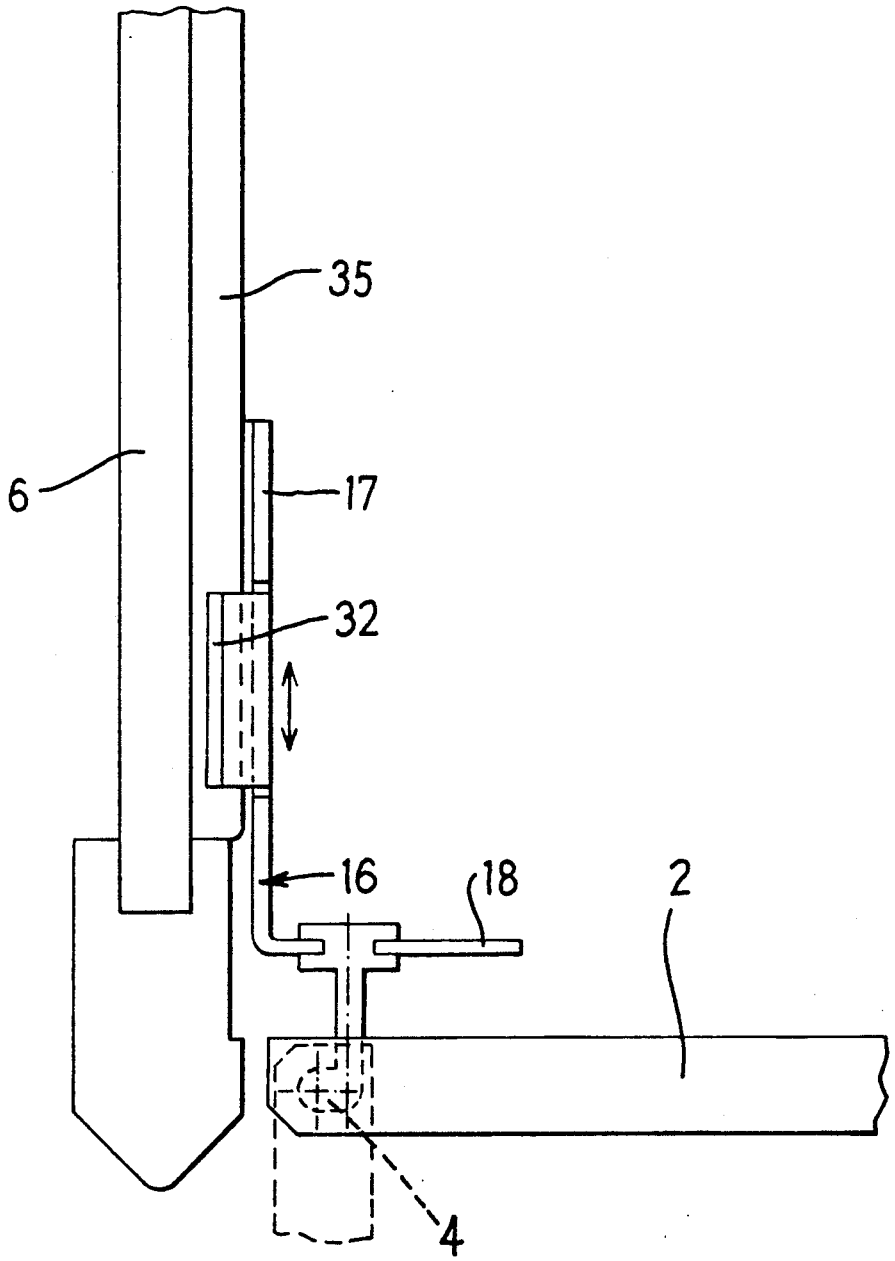
FIG. 6 is a top view of the end area of the outside wall of the closet and of the carrier element with the door panels being in the closed position.

FIG. 6 is a top view of the carrier element 16 showing in particular the design of the second hinge arrangement 4 for the support of the second door panel 2. FIG. 6 shows furthermore schematically a ball roller guide mechanism 35 which is fastened on the outside wall 6 to facilitate the movement of the carrier element 16.

Figure 10:
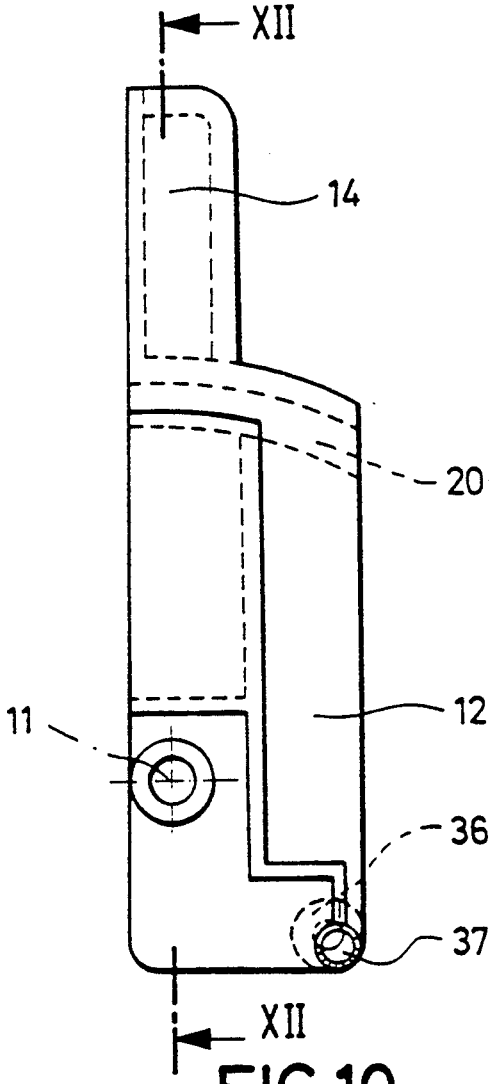
FIG. 10 is a side view of the lever.
Figure 13:
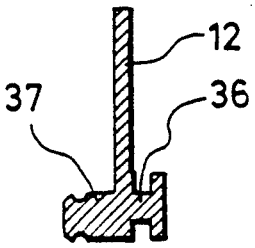
FIG. 13 is a cross-sectional view taken along the line XIII—XIII of FIG. 9.
Figure 14:
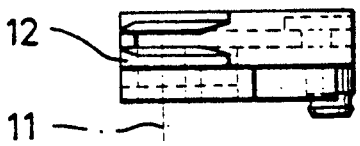
FIG. 14 is a top view of the lever.
Figure 11:
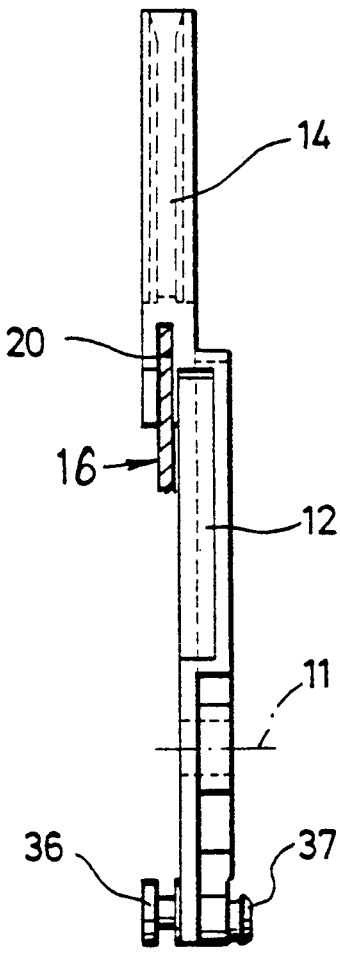
FIG. 11 is a rear view of the lever.
Figure 12:
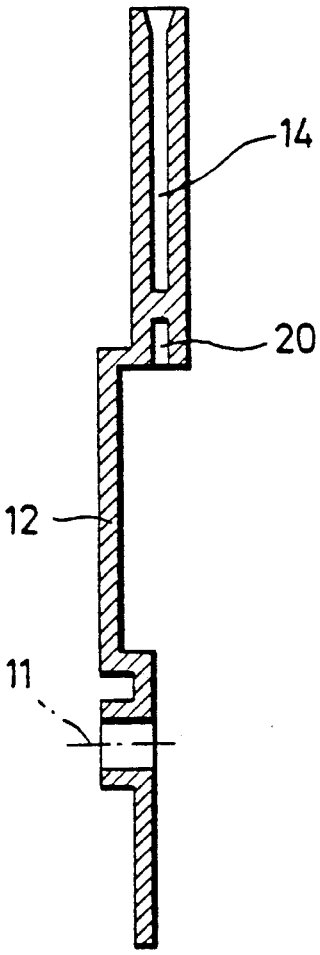
FIG. 12 is a cross-sectional view of the lever taken along the line XII—XII of FIG. 10.
Figure 15:
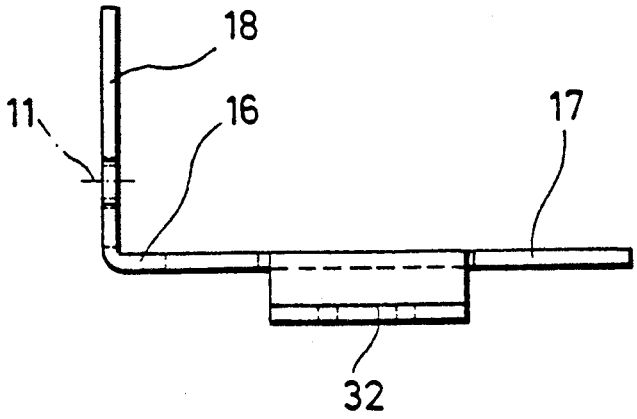
FIG. 15 is a front view of the carrier element illustrated in FIGS. 7 and 8.

FIGS. 9-14 each show views of the lever of the invention, which lever is supported on the carrier element 16. The side view shown in FIG. 10 corresponds with the arrangement shown in the illustration of FIG. 5. It can thereby be seen that the lever 12 is pivotally supported on the carrier element 16 by means, such as an axle rod (not numerically identified), received in an opening thereon which is axially aligned with the horizontal axis 11. The lever 12 has a bolt-like structure 36 at its lower end, which bolt-like structure is guided in the guide slot 31 of the carrier element 16. The bolt-like structure 36 together with the guide slot 31 limits the swivelling movement of the lever 12. The lever 12 is furthermore formed so as to have an arch-shaped groove 20, the centerpoint of curvature of which, as can be seen in FIG. 10, is at the axis 11. The groove 20 is arranged and dimensioned such that the upper, arch-shaped edge 19 of the second leg 18 of the carrier element 16 can be guided in the groove in order to guide and hold the lever 12 in a suitable manner.

An attachment having a slot 14 is provided at the upper area of the lever 12. The slot 14 is dimensioned such that the attachment 15 of the guide element 7 can be moved into and out of the slot, when the first and the second door panels are in the folded parallel position. By pressing the first door panel 1 against the second door panel 2, the attachment 15 is guided into the slot 14 and the lever is at the same time swung from the blocking position 12A (FIG. 5) into an unblocking position 12B, in which same is substantially in alignment with the second leg 18 thus permitting a movement of the carrier element 16 into the storage space 23. As soon as the first door panel 1 is swivelled away from the lever 12, the lever 12 is initially swivelled by the spring force of the spring element 13 connected to a bolt-like extension 37 provided at the lower end of the lever 12. Thus, the lever projects laterally beyond the storage space 23 when in the blocking position 12A and would during an attempted storing operation strike against the inside wall 24. On the other hand, a lower end 12C of the lever could also extend into a recess 6A provided on the outside wall 6, which recess is shown in FIG. 5A, so that a shifting movement of the carrier element 16 is prevented. From this results at the same time that it is not possible during the stored condition of the door panels 1, 2 to swivel the door panels with respect to one another, because the attachment 15 of the guide element 7, which is in the slot 14 of the lever 12, prevents such a swivelling because of the tight fit and the pivoting thereof occurring during a swivelling of the door panels 1, 2 with respect to one another.

Figure 16:
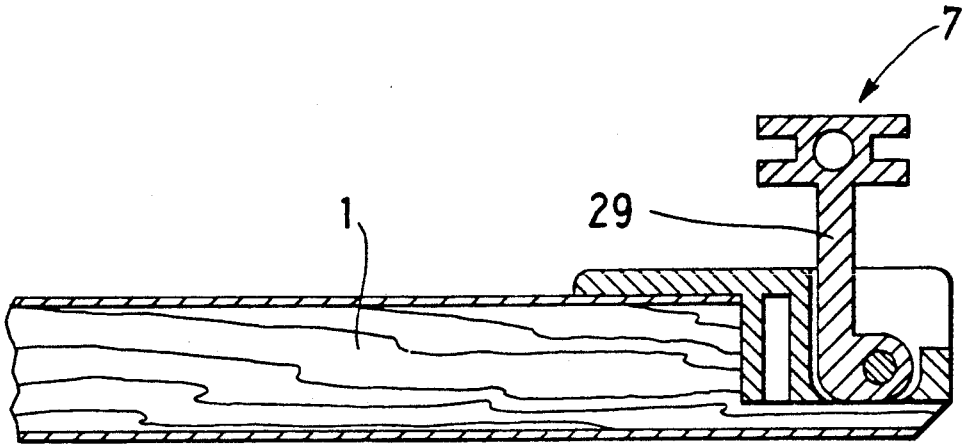
FIG. 16 is a cross-sectional top view of the end area of the second door panel, similar to the illustration shown in FIG. 6.

FIG. 16 illustrates in detail in a cross-sectional view the rotary fitting 29 already described in connection with FIG. 19, with the help of which rotary fitting the guide element 7 is pivotally supported on the first door panel 1.

The invention is not to be limited to the illustrated exemplary embodiments. Many other possibilities for changes and modifications exist without departing from the scope of the invention.

The embodiments of the invention in which an exclusive property or privilege is claimed are defined as follows:

1. In a folding door storage system for an opening into a closet, said folding door system having first and second door panels secured together by means of a first hinge arrangement, a carrier arrangement secured to said second door panel by means of a second hinge arrangement, and a support means for supporting said carrier arrangement for horizontal movement on and parallel to a side wall of the closet, which side wall is oriented in a plane generally at a right angle to a plane of the opening into the closet, the improvement wherein a first elongated guide rail is provided and is arranged parallel to the plane of the closet opening, wherein a second elongated guide rail is provided and is arranged parallel the plane of the side wall, wherein said first and second guide rails are located above said first and second door panels, wherein said first door panel includes a guide element pivotally secured thereto for pivotal movement about a vertical axis, said guide element being oriented adjacent an end of said first door panel remote from said second door panel, said guide element having at least one rotatable guide wheel movably engaged with said first guide rail, wherein mounting means are provided for rotatably supporting said guide wheel for rotation about a horizontal axis extending perpendicular to a longitudinal axis of said first guide rail to facilitate a rolling movement of said guide wheel on and relative to said first guide rail, wherein said guide element further includes a further guide wheel adapted for movement into engagement with said second guide rail when said first and second door panels are first folded to a fully opened position relative to said closet opening, said fully opened position being defined by both of said first and second door panels being oriented in a plane generally parallel to the plane of the side wall, said further guide wheel becoming longitudinally aligned with said second guide rail when said first and second door panels are in said fully opened position, and wherein a locking means is arranged on the carrier arrangement for preventing a movement of the carrier arrangement, when the door panels are not completely in a folded state defining said fully opened condition, in a direction parallel to the plane of the side wall into a storage position oriented side-by-side with the side wall as well as preventing a swivelling of the door panels when the door panels are located in the storage position.

2. The system according to claim 1, wherein said locking means includes a lever pivotally mounted on a horizontal axle on said carrier arrangement and extending perpendicular to the plane of the closet opening, said lever being pivotal between a first unblocking position engaging with said first door panel and a second blocking position engaging a stop in order to prevent the movement of said first and second door panels and the carriage arrangement to the said storage position.

3. The system according to claim 2, wherein said lever is initially biassed into said blocking position thereof by means of a spring element.

4. The system according to claim 2, wherein said lever includes means defining a slot, and wherein said guide element includes a platelike attachment arranged perpendicularly with respect to a plane of said first door panel when said first and second door panels are in said fully opened condition, said attachment being received in said slot when said lever is in said unblocking position thereof.

5. The system according to claim 2, wherein said carrier arrangement includes an L-shaped carrier element having a first leg arranged so that it is aligned parallel with respect to the side wall and a second leg arranged so that it extends toward the inside of the closet opening.

6. The system according to claim 5, wherein said lever is supported on said second leg.

7. The system according to claim 6, wherein said lever includes an arched-shaped groove therein, and wherein said second leg has an arch-shaped rounded portion at an upper edge thereof received into said arch-shaped groove on said lever.

8. The system according to claim 7, wherein a central portion of said lever is supported on said second leg.

9. The system according to claim 8, wherein a lower end of said lever, in the blocking position thereof, is guided into a recess in the side wall for locking the carrier element to the side wall.

10. The system according to claim 9, wherein said second hinge arrangement is supported on said carrier element.

11. The system according to claim 3, wherein said spring element is hinged to a lower end area of said lever.

12. The system according to claim 5, wherein a gear is rotatably supported at both an upper and a lower area of said carrier element, each said gear mating with a horizontal rack arranged on the side wall.

13. The system according to claim 12, wherein said gears are fastened to a common axle.

14. The system according to claim 12, wherein each said rack and said gear are a duplicate of each other in order to eliminate any play and are offset with respect to one another a portion of a pitch of said gears.

* * * * *